US010017357B2

(12) United States Patent
Xu

(10) Patent No.: US 10,017,357 B2
(45) Date of Patent: Jul. 10, 2018

(54) NODAL POINT PRESSURE-EQUALISING DEVICE OF STEEL ROPE SETS FOR ELEVATOR

(71) Applicant: SUZHOU BALANCED TRANSMISSION EQUIPMENT CO., LTD, Suzhou (CN)

(72) Inventor: Xinghua Xu, Suzhou (CN)

(73) Assignee: SUZHOU BALANCED TRANSMISSION EQUIPMENT CO., LTD., Suzhou (CN)

( * ) Notice: Subject to any disclaimer, the term of this patent is extended or adjusted under 35 U.S.C. 154(b) by 211 days.

(21) Appl. No.: 15/016,237

(22) Filed: Feb. 4, 2016

(65) Prior Publication Data

US 2016/0152444 A1 Jun. 2, 2016

Related U.S. Application Data

(63) Continuation of application No. PCT/CN2014/081884, filed on Jul. 9, 2014, and a (Continued)

(30) Foreign Application Priority Data

Aug. 12, 2013 (CN) ..... 2013 1 0347687
Aug. 12, 2013 (CN) ..... 2013 1 0347688
(Continued)

(51) Int. Cl.
*B66B 7/08* (2006.01)
*B66B 7/10* (2006.01)

(52) U.S. Cl.
CPC ..... *B66B 7/10* (2013.01)

(58) Field of Classification Search
CPC ..... B66B 7/10
See application file for complete search history.

(56) References Cited

U.S. PATENT DOCUMENTS 1,924,690 A * 8/1933 Lindstrom ..... B66B 7/10 187/412
2,089,143 A * 8/1937 White ..... B66B 7/10 187/412
6,341,669 B1 1/2002 St. Pierre et al.

FOREIGN PATENT DOCUMENTS

CN 1054952 A 10/1991
CN 201092501 Y 7/2008
(Continued)

*Primary Examiner* — William E Dondero
*Assistant Examiner* — Diem M Tran
(74) *Attorney, Agent, or Firm* — Perkins Coie LLP

(57) ABSTRACT

A nodal point pressure-equalizing device of steel rope sets for an elevator, including a pressure-equalizing device main body, a base seat, a first nodal point component and a second nodal point component. The pressure-equalizing device main body can be rotatably provided on the base seat. The first nodal point component and the second nodal point component are respectively arranged at both ends of the pressure-equalizing device main body and are respectively matched with and connected with the corresponding steel rope set. The first nodal point component and the second nodal point component can respectively rotate around rotational centers thereof, and the rotational centers and the rotational center of the pressure-equalizing device main body are on the same horizontal plane.

16 Claims, 4 Drawing Sheets

Related U.S. Application Data continuation of application No. PCT/CN2014/081885, filed on Jul. 9, 2014, and a continuation of application No. PCT/CN2014/081886, filed on Jul. 9, 2014, and a continuation of application No. PCT/CN2014/081887, filed on Jul. 9, 2014, and a continuation of application No. PCT/CN2014/081888, filed on Jul. 9, 2014.

(30) Foreign Application Priority Data

| | | |
|---|---|---|
| Aug. 12, 2013 | (CN) | 2013 1 0347690 |
| Aug. 12, 2013 | (CN) | 2013 1 0347751 |
| Aug. 12, 2013 | (CN) | 2013 1 0347752 |

(56) References Cited

FOREIGN PATENT DOCUMENTS

| | | | |
|---|---|---|---|
| CN | 101633464 | A | 1/2010 |
| CN | 202201604 | U | 4/2012 |
| CN | 202785168 | U | 3/2013 |
| CN | 203428687 | U | 2/2014 |
| CN | 203428688 | U | 2/2014 |
| CN | 203428690 | U | 2/2014 |
| CN | 203428691 | U | 2/2014 |
| CN | 203428692 | U | 2/2014 |
| JP | 8-99784 | A | 4/1996 |
| SU | 918236 | A1 | 4/1982 |
| WO | 02/00541 | A1 | 1/2002 |

* cited by examiner

NODAL POINT PRESSURE-EQUALISING DEVICE OF STEEL ROPE SETS FOR ELEVATOR

This is a continuation of PCT/CN2014/081885, filed on Jul. 9, 2014, which claims priority to CN2013103477520, filed on Aug. 12, 2013. This is also a continuation of PCT/CN2014/081887, filed Jul. 9, 2014, which claims priority to CN2013103477516, filed on Aug. 12, 2013. This is also a continuation of PCT/CN2014/081884, filed Jul. 9, 2014, which claims priority to 2013103476903, filed on Aug. 12, 2013. This is also a continuation of PCT/CN2014/081888, filed Jul. 9, 2014, which claims priority to 2013103476886, filed on Aug. 12, 2013. This is also a continuation of PCT/CN2014/081886, filed Jul. 9, 2014, which claims priority to 2013103476871, filed on Aug. 12, 2013.

TECHNICAL FIELD

The invention relates to a pressure-equalising device of steel rope sets for an elevator, and more particularly, to a nodal point pressure-equalising device of steel rope sets for an elevator capable of regulating a force sustained to several steel rope sets and enabling the force sustained among the steel rope sets to be the same.

BACKGROUND ART

At present, domestic and overseas elevators generally adopts a traction machine to drive. A traction elevator suspending and lifting system is composed of a traction wheel, steel rope sets, a car platform sill, a balance block system and other main parts; a friction force generated by winding each steel rope of the steel rope set in a groove of the traction wheel in the traction elevator suspending and lifting system provides a power for the car platform sill to lift up or down; under the adjustment that the elevator driving technology keeps developing, both the lifting height of the elevator and the running speed are greatly improved, at the same time, higher requirements are also proposed on the safety and the reliability of the elevator. Theoretically, the force sustained to each steel rope in the steel rope set shall be the same in the using process of the elevator, and the shape and the size of the groove for winding the steel rope on the traction wheel shall also be the same; but in the actually using process, the force sustained to each steel rope in the steel rope set shall be different due to various reasons, this results in a situation that some steel ropes are forced highly and some steel ropes are forced lowly; the friction force between the highly-forced steel rope and the groove on the corresponding traction wheel will relatively higher, this results in a condition that the friction of the groove on the corresponding traction wheel is more severe, so the shape and the size of the groove on the corresponding traction wheel are changed over time, resulting in that the highly-forced steel rope is forced more and more in work. If the radius of the worn groove on the traction wheel is reduced by 0.1 mm, the steel rope will move less than 0.314 mm; by taking the 20-storey building for example, the traction wheel will rotate about 100 turns, so the steel rope will move less than 31.4 mm. Through test, it is discovered that the steel rope will forced more than about 3000N; when the steel rope in the steel rope set is forced unevenly, a wriggling phenomenon is generated between the lowly-forced steel rope and the traction wheel, the wriggling between the steel rope and the traction wheel will cause the abrasion of the steel rope and the traction wheel; the higher the storey is, the more severe the situation above becomes. Therefore, the highly-forced steel rope used for a long time is easy to break in the using process, resulting in safety accidents of the elevator; at the same time, the lowly-forced steel rope will also be damaged due to the abrasion of the traction wheel. If the damage is severe, the steel rope will also be broken to result in the safety accidents of the elevator; for this reason, we develop a two nodal point pressure-equalising device of steel rope sets for an elevator capable of adjusting the force to two steel rope sets and enabling these two steel rope sets to force the same.

SUMMARY OF THE INVENTION

The object of the invention is to overcome the shortages of the prior art and is intended to provide a nodal point pressure-equalising device of steel rope sets for an elevator capable of adjusting the force to several steel rope sets and enabling several steel rope sets to force the same.

In order to achieve the object above, the invention adopts the main technical scheme as follows: a nodal point pressure-equalising device of steel rope sets for an elevator includes a pressure-equalising device main body, a base seat, a first nodal point component and a second nodal point component, wherein the pressure-equalising device main body can be rotatably provided on the base seat; the first nodal point component and the second nodal point component are respectively arranged at both ends of the pressure-equalising device main body and are respectively matched with and connected with the corresponding steel rope set; the rotational center of the pressure-equalising device main body is located on the center line of the pressure-equalising device main body; the first nodal point component and the second nodal point component can respectively rotate around rotational centers thereof, the rotational centers and the rotational center of the pressure-equalising device main body are on the same horizontal plane, and the moment of the first nodal point component relative to the center line of the pressure-equalising device main body is equal to the moment of the second nodal point component relative to the center line of the pressure-equalising device main body.

In addition, the invention further provides auxiliary technical scheme as follows:

The first nodal point component and the second nodal point component respectively include at least one spherical nodal point and at least one spherical cavity, and the spherical nodal point is accommodated in the spherical cavity and can rotate or swing.

The first nodal point component and the second nodal point component respectively include one spherical nodal point, the pressure-equalising device main body is symmetrically provided with 2 spherical cavities; and the spherical nodal point is arranged in each spherical cavity, and can rotate or swing.

The lower portion of the pressure-equalising device main body is provided with a rotating mount; the center line of the pressure-equalising device main body and the center line of the rotating mount are collinear; the bottom of the rotating mount is provided with an arc-shaped bump; the base seat is provided with an arc-shaped groove; and when the arc-shaped bump is arranged in the arc-shaped groove, the arc-shaped bump can rotate around the arc-shaped groove.

The first nodal point component includes a first spherical nodal point; the center of the first spherical nodal point is provided with a first through hole; the first through hole is used for mounting the steel rope set; the second nodal point component is symmetrically provided with 2 second spherical nodal points along the center surface of the second nodal point component; the rotational center of the second nodal point component is located on the center surface; the center of the second spherical nodal point is provided with a second through hole; and the second through hole is used for mounting the steel rope set.

The rotational center of the second nodal point component and the rotational center of these 2 second spherical nodal points arranged on the second nodal point component are on the same horizontal plane and are collinear; and the rotational center of the second nodal point component, the rotational center of the pressure-equalising device main body and the rotational center of the first nodal point component are on the same horizontal plane and are collinear.

The distance from the rotational center of the second nodal point component to the rotational center of the pressure-equalising device main body is half of the distance from the first nodal point component to the rotational center of the pressure-equalising device main body.

The bottom of the pressure-equalising device main body is provided with a first spherical bump; the base seat is provided with a first spherical cavity; the first spherical bump is placed in the first spherical cavity, and the first spherical bump can rotate around the first spherical cavity.

The lower portion of the second nodal point component is provided with a rotating mount; the center surface of the second nodal point component is overlapped with the center surface of the rotating mount arranged on the second nodal point component; the bottom of the rotating mount is provided with a second spherical bump; one end of the pressure-equalising device is provided with a second spherical cavity; the other end is provided with a fourth spherical cavity; the second spherical bump is arranged in the second spherical cavity; the second spherical bump can rotate around the second spherical cavity; the fourth spherical cavity is internally provided with a first spherical nodal point; and the first spherical nodal point can rotate around the fourth spherical cavity.

The second nodal point component is symmetrically provided with 2 third spherical cavities along the center surface; each third spherical cavity is internally mounted with a second spherical nodal point, and each second spherical nodal point can rotate in the third spherical cavity.

The pressure-equalising device main body is provided with a screw hole, and screws can fix the rotating mount at the lower portion of the pressure-equalising device main body via the screw hole.

The first nodal point component comprises a balancing seat and three spherical nodal points mounted on the balancing seat.

The balancing seat is in a shape of right triangle, these three spherical nodal points are located on positions of three included angles and are arranged in a way of centrosymmetry.

The second nodal point component comprises a balancing seat and two spherical nodal points symmetrically mounted on the balancing seat together.

The first nodal point component and the second nodal point component are respectively provided with rotating mounts, the rotating mount is provided with a spherical bump, both ends of the pressure-equalising device main body are respectively provided with a spherical cavity, and the spherical bump can be arranged in the spherical cavity in a swinging way.

The distance from the rotational center of the second nodal point component to the rotational center of the pressure-equalising device main body is 1.5 times of the distance from the rotational center of the first nodal point component to the rotational center of the pressure-equalising device main body.

For the nodal point pressure-equalising device of the steel rope sets for the elevator, the rotational center of the first nodal point component, the rotational center of the second nodal point component and the rotational center of the pressure-equalising device main body are located on the same plane and are collinear.

The base seat is uniformly distributed with fixed holes to conveniently mount the base seat.

The nodal point pressure-equalising device of the steel rope sets for the elevator is mounted at the heat or the tail of the steel rope.

Due to the use of the technical scheme above, the invention has the advantages as follows compared to the prior art: the provided nodal point pressure-equalising device of the steel rope sets of the elevator is mainly well designed by means of the lever principle and can adjust more than two steel rope sets, and the device can adjust the pressure sustained by two sets of steel ropes, and when a stable state is reached, the pressure sustained by each steel rope set will be the same, thereby enabling the damage caused by unequal pressure sustained by steel ropes for an elevator to be overcome. In this way, the service life of the steel rope set is prolonged and the safety of the elevator is improved.

BRIEF DESCRIPTION OF THE DRAWINGS

The technical scheme of the invention will be further described hereinafter with reference to the drawings.

DETAILED DESCRIPTION OF THE PREFERRED EMBODIMENTS

The invention will be further described in details with reference to the drawings and the specific embodiments hereinafter. The invention totally provides three embodiments, each of which will be respectively described in details hereinafter, wherein the same or similar structure in different embodiments adopts the same mark number and unnecessary details will not be given any more.

Embodiment 1

Figure 1:
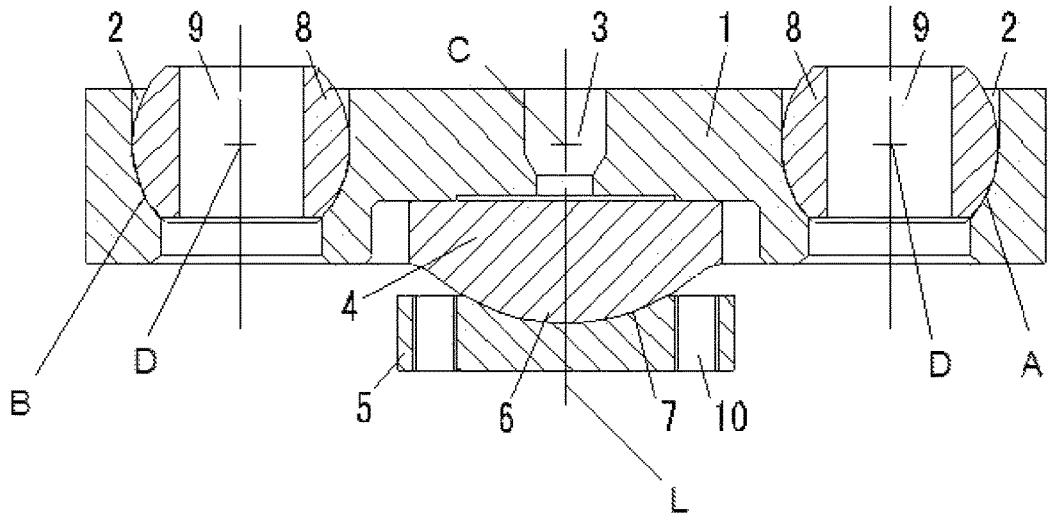
FIG. 1 is a sectional view of a nodal point pressure-equalising device of steel rope sets for an elevator corresponding to the first embodiment according to the invention.

FIG. 1 is a nodal point pressure-equalising device of steel rope sets for an elevator corresponding to the first embodiment according to the invention, which is mounted at the head or tail of a dragging steel rope set (without being shown in the figure) and includes a pressure-equalising device main body 1; the pressure-equalising device main body 1 can be rotatably arranged on a base seat 5; the pressure-equalising device main body 1 is symmetrically provided with a first nodal point component and a second nodal point component; corresponding to the embodiment, the first nodal point component A and the second nodal point component B respectively include a spherical nodal point 8 to mount two steel rope sets; the center of the spherical nodal point 8 is provided with a through hole 9; the through hole 9 is used for mounting one of the steel rope sets; the spherical nodal point 8 can rotate or swing around the pressure-equalising device main body 1; the rotational center C of the pressure-equalising device main body 1 is located on the center line L of the pressure-equalising device main body 1; and the rotational center D of each spherical nodal point 8 and the rotational center of the pressure-equalising device main body 1 are on the same horizontal plane and are collinear. At the same time, the moment (the force multiplying by the distance) of the first nodal point component A relative to the center line L is equal to the moment of the second nodal point component B relative to the center line L.

In the embodiment, as shown in FIG. 1, the pressure-equalising device main body 1 is symmetrically provided with 2 spherical cavities 2 along the center line; the spherical nodal point 8 is arranged in each spherical cavity 2 and can rotate; the lower portion of the pressure-equalising device main body 1 is provided with a rotating mount 4; the center line L of the pressure-equalising device main body 1 and the center line of the rotating mount 4 are collinear; the bottom of the rotating mount 4 is provided with an arc-shaped bump 6; the base seat 5 is provided with an arc-shaped groove 7; when the arc-shaped bump 6 is placed in the arc-shaped groove 7, the arc-shaped bump 6 can rotate or swing around the arc-shaped groove 7; the pressure-equalising device main body 1 is provided with a screw hole 3, screws (without being shown) can fix the rotating mount 4 at the lower portion of the pressure-equalising device main body 1 via the screw hole 3; and the base seat 5 is uniformly distributed with fixed holes 10 to conveniently mount the base seat 5.

Of course, in the embodiment, the arc-shaped bump 6 can also be set as a spherical bump, and the corresponding arc-shaped groove 7 is set as a spherical groove.

Due to the use of the technical scheme above, the invention has the advantages as follows compared to the prior art: a nodal point pressure-equalising device of steel rope sets for an elevator provided in the invention is specifically a two nodal point pressure-equalising device, which enables each independent traction steel rope to have a mechanics relationship correlative to the other steel rope by means of an oscillating bar and the lever principle, i.e., the change in the force sustained to any steel rope will transmit to the first nodal point component or the second nodal point component under the condition that the force is sustained to the traction steel rope set, and the spherical nodal point is forced to swing to enable the pressure-equalising device main body to lose balance to swing around the rotational center C. In this way, the change in the force sustained to the spherical nodal point will be transmitted to the other spherical nodal point to enable the force sustained to these two spherical nodal points to balance, i.e., the force sustained to each steel rope set to be equal by means of the lever principle.

The embodiment can automatically adjust the force sustained to these two steel rope sets, the force sustained to these two steel rope sets will be the same when the invention achieves the stable state, so damages caused by different forces sustained to the steel able sets for the elevator can be overcome. In this way, the service life of the steel rope set is prolonged and the safety of the elevator is improved.

Embodiment 2

Figure 2:
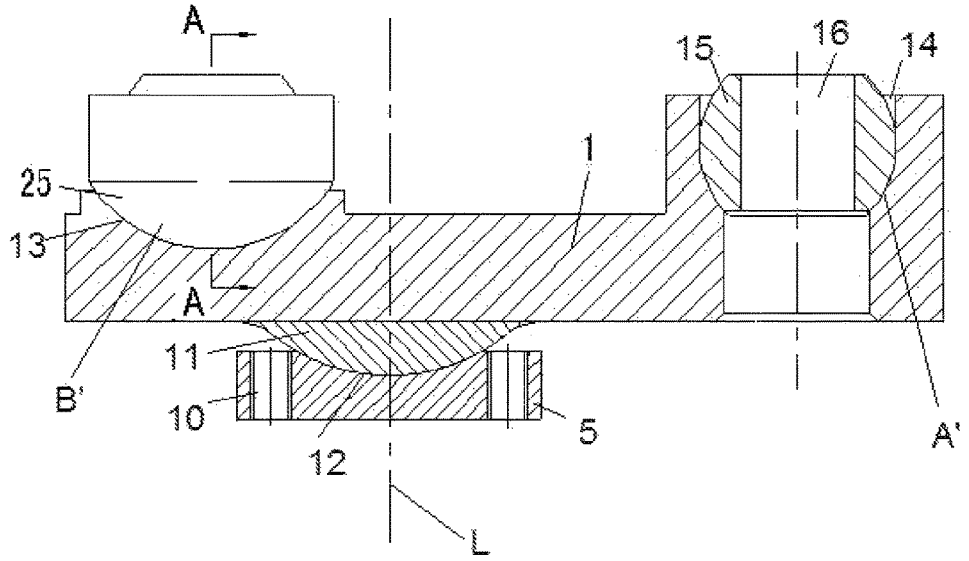
FIG. 2 is a sectional view of a nodal point pressure-equalising device of steel rope sets for an elevator corresponding to the second embodiment according to the invention.
Figure 3:
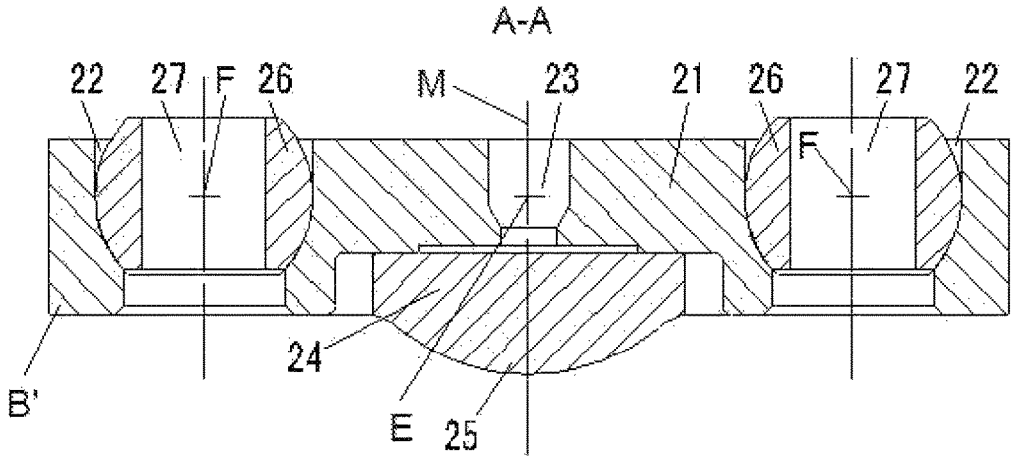
FIG. 3 is a sectional view along an A-A line in FIG. 2.
Figure 4:
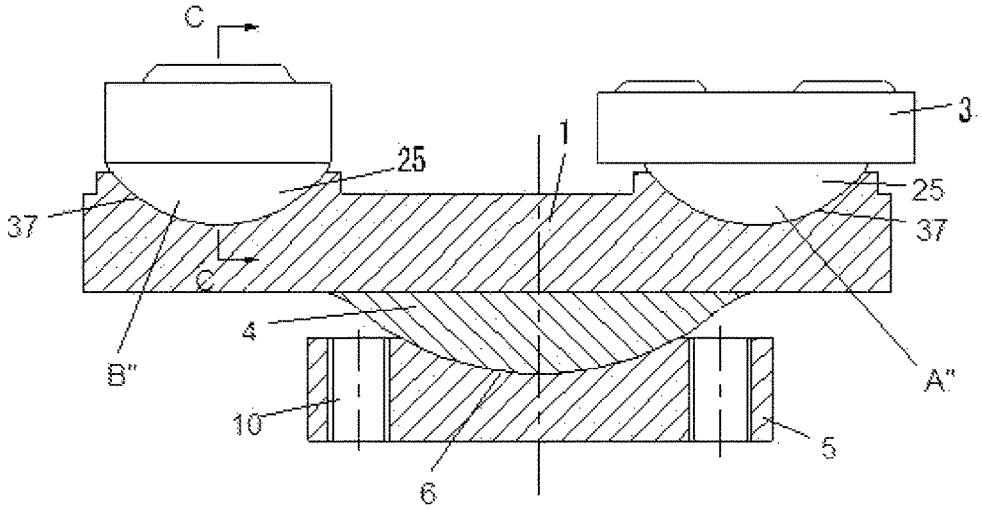
FIG. 4 is a sectional view of a nodal point pressure-equalising device of steel rope sets for an elevator corresponding to the third embodiment according to the invention.
Figure 5:
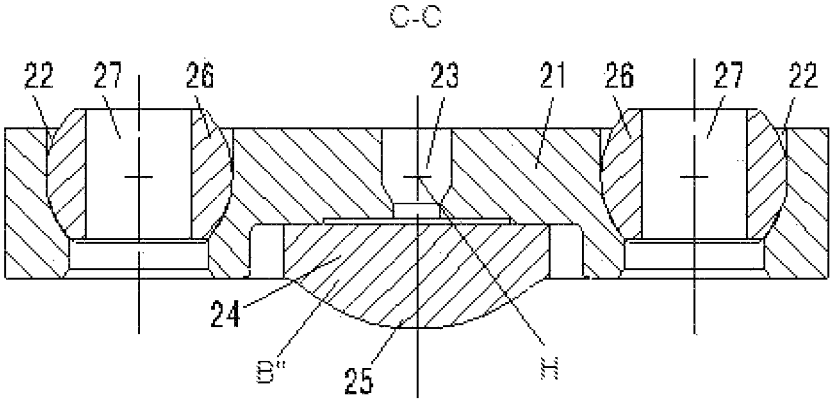
FIG. 5 is a sectional view along a C-C line in FIG. 4.
Figure 6:
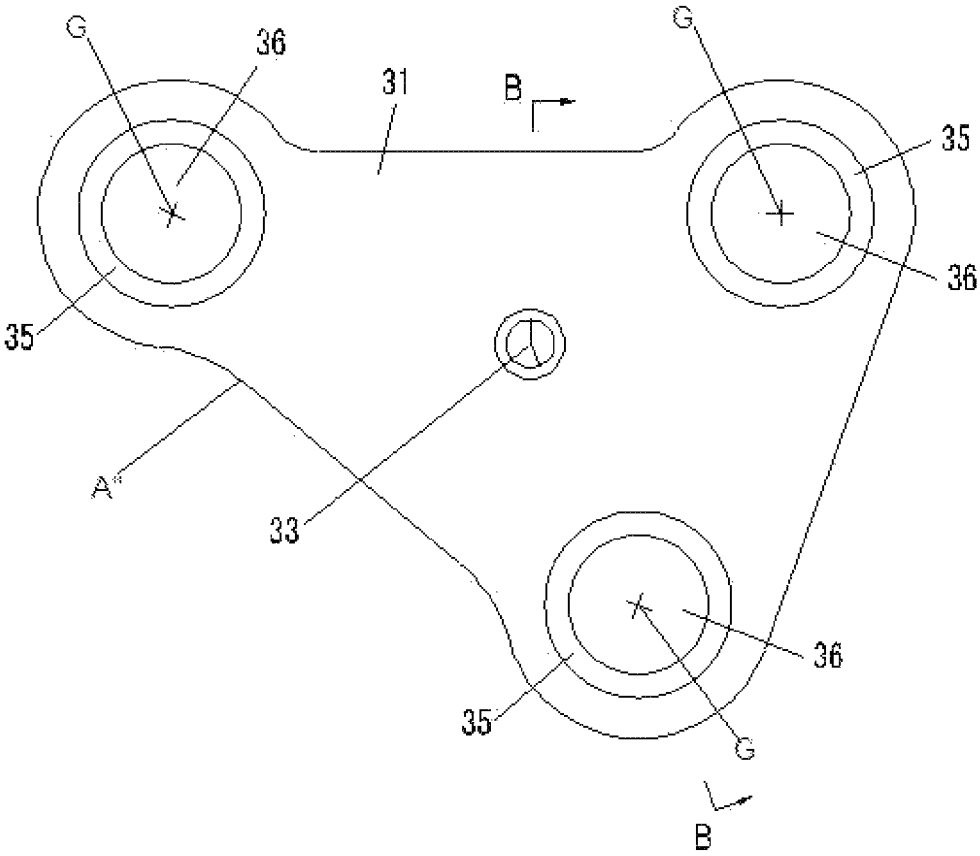
FIG. 6 is a planar graph of a first nodal point component of the nodal point pressure-equalising device in FIG. 4.
Figure 7:
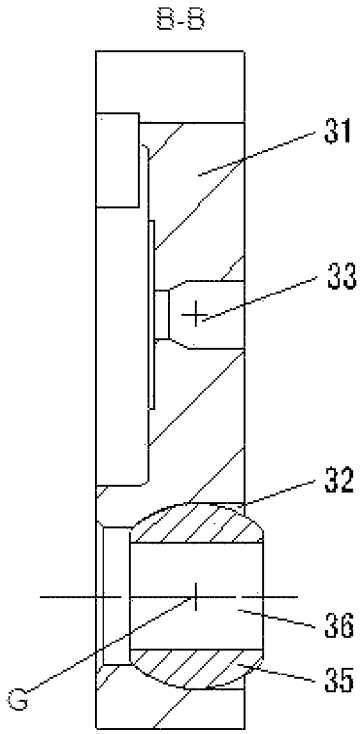
FIG. 7 is a sectional view along a B-B line in FIG. 6.

FIG. 2 and FIG. 3 are a nodal point pressure-equalising device of steel rope sets for an elevator corresponding to the second embodiment according to the invention, which is mounted at the head or tail of three steel rope sets and includes a pressure-equalising device main body 1 and a first nodal point component A' and a second nodal point component B' arranged at both ends of the pressure-equalising device main body 1; similarly, the pressure-equalising device main body 1 can be arranged on a base seat in a rotating or swinging way; the structure of the first nodal point component A' of the embodiment is the same as the structure of the first nodal point component A' in the first embodiment, the first nodal point component A' also includes a first spherical nodal point 15; the first spherical nodal point 15 can rotate or swing around the pressure-equalising device main body 1; the center of the first spherical nodal point 15 is provided with a first through hole 16; the first through hole 16 is used for mounting one steel rope set (without being shown); while the second nodal point component B' includes a balancing seat 21 and is symmetrically provided with 2 second spherical nodal points 26 along the center surface M; the rotational center E of the second nodal point component B' is located on the center surface M; the center of the second spherical nodal point 26 is provided with a second through hole 27; the second through hole 27 is used for mounting one steel rope set (without being shown); the rotational center E of the second nodal point component B' and the rotational center F of 2 second spherical nodal points 26 arranged thereon are on the same horizontal plane and are collinear; the rotational center E of the second nodal point component B', the rotational center (without being marked) of the pressure-equalising device main body 1 and the rotational center of the first spherical nodal point 15 (without being marked) are on the same horizontal plane and are collinear; and the distance from the rotational center E of the second nodal point component B' to the rotational center of the pressure-equalising device main body 1 is half of the distance from the first nodal point component A' to the rotational center of the pressure-equalising device main body 1. In this way, the moment of the first nodal point component A' and the second nodal point component B' is equal to the moment of center line L of the pressure-equalising device main body 1 relatively.

In the embodiment, the bottom of the pressure-equalising device main body 1 is provided with a first rotating mount 11; the base seat 5 is provided with a first spherical cavity 12; the first rotating mount 11 is placed into the first spherical cavity 12, the first rotating mount 11 can rotate around the first spherical cavity 12; in addition, the lower portion of the second nodal point component B' is provided with a second rotating mount 24, the center surface M of the second nodal point component B' is overlapped with the center surface of the second rotating mount 24; the bottom of the second rotating mount 24 is provided with a second spherical bump 25; one end of the pressure-equalising device main body 1 is provided with a second spherical cavity 13; the other end is provided with a fourth spherical cavity 14; the second spherical bump 25 is arranged in the second spherical cavity 13; the second spherical bump 25 can rotate around the second spherical cavity 13; the fourth spherical cavity 14 is internally provided with a first spherical nodal point 15; the first spherical nodal point 15 can rotate around the fourth spherical cavity 14; the second nodal point component B' is symmetrically provided with 2 third spherical cavities 22 along the center surface; each third spherical cavity 22 is internally provided with a second spherical nodal point 26, each second spherical nodal point 26 can rotate along the third spherical cavity 22 arranging the second spherical nodal point 26; the second nodal point component B' is provided with a screw hole 23, the second rotating mount 24 can be fixed at the lower portion of the second nodal point component B via the screw hole 23; and the base seat is uniformly distributed with fixed holes 10 to conveniently mount the base seat 5.

It is thus clear that the nodal point pressure-equalising device of the steel rope sets for the elevator of the embodiment is 3 nodal point pressure-equalising devices specifically, including a first nodal point component A' having one spherical nodal point 15 and a second nodal point component B' having two spherical nodal points 26, the first nodal point component A' and the first nodal point component A in the first embodiment have much the same configuration, while the second nodal point component B' is equivalent to the configuration after removing the base seat 5 in the first embodiment. The embodiment the same as the first embodiment enables the force sustained to each steel rope set to be the equal by means of the lever principle, so in the running process of the elevator, the friction force generated by winding the traction steel rope in the traction wheel groove is consistent as each traction steel rope is forced equally, and the traction steel rope and the traction wheel groove will not generate a relatively sliding phenomenon. As a result, the abrasion on the traction steel rope and the traction wheel groove is reduced, the service life of the traction wheel groove and the traction steel rope is prolonged, and the safety and the reliability of the elevator are also improved.

Embodiment 3

See FIG. 4 to FIG. 7, the nodal point pressure-equalising device of the steel rope sets for the elevator of the third embodiment according to the invention is mounted at the head or tail of the steel rope set, and at the same includes a pressure-equalising device main body 1, a base seat 5 and a first nodal point component A" and a second nodal point component B" located at both ends of the base seat 5, similarly, the pressure-equalising device main body 1 can be mounted on the base seat 5 via the rotating mount 4 in a rotating or swinging way. In addition, the second nodal point component B" and the second nodal point component B' in the second embodiment have much the same configuration, so the detailed description is omitted here.

The first nodal point component A" includes a balancing seat 31 and three third spherical nodal points 35 mounted on the balancing seat 31. The balancing seat 31 is generally in a shape of right triangle, these three spherical nodal points 35 are located on positions of three included angles and are arranged in a way of centrosymmetry. The swinging center 33 of the first nodal point component A" is overlapped with the center of gravity. The center of each third spherical nodal point 35 is provided with a third through hole 36; the third through hole 36 is used for mounting the steel rope (without being shown); and the balancing seat 31 is provided with three spherical cavities 32 for accommodating the corresponding third spherical nodal point 35. The swinging center 33 of the first nodal point component A" and the swinging center G of these 3 third spherical nodal points 35 arranged on the first nodal point component A" are on the same horizontal plane; swinging center 33 of the first nodal point component A", the swinging center of the pressure-equalising device main body 1 (without being marked) and the swinging center H of the second nodal point component B" are on the same horizontal plane and are collinear; at the same time, the distance from the swinging center H of the second nodal point component B" to the swinging center of the pressure-equalising device main body 1 is 1.5 times of the distance from the swinging center of the first nodal point component A" to the swinging center of the pressure-equalising device main body 1.

In the embodiment, the rotating mount 24 having the spherical bump 25 is arranged below the first nodal point component A" and the second nodal point component B" respectively and is respectively mounted in the spherical cavities 37 at both ends of the pressure-equalising device main body 1. It is thus clear that the nodal point pressure-equalising device of the steel rope sets for the elevator provided in the third embodiment is 5 nodal point pressure-equalising devices, which are provided with a first nodal point component A" having three spherical nodal points and a second nodal point component B" having two spherical nodal points. The same lever principle as the first embodiment and the second embodiment is adopted so that the force sustained to each steel rope set is equal.

In summary, only if the different nodal point pressure-equalising devices of the steel rope set for the elevator described in the invention adopt the above arrangement and lever principle, the configuration and combination can be diversified to apply in the several nodal point pressure-equalising devices. All multi-nodal point pressure-equalising devices without 2 nodal points can be combined, for example, two nodal point pressure-equalising device can be combined as a 4-nodal point pressure-equalising device, two 3-nodal point pressure-equalising device can be combined as a 6-nodal point pressure-equalising devices, etc., so as to be sustained in different steel rope sets for various elevators.

The embodiments above are only for describing the technical through and features of the invention, with a view to enabling the technical personnel who are familiar with the technology to understand the content of the invention and implement, but not intended to limit the protection scope of the invention. Any equivalent change or modification made according to the spiritual essence of the invention shall all fall within the protection scope of the invention.

I claim:

1. A nodal point pressure-equalising device of steel rope sets for an elevator, comprising a pressure-equalising device main body, a base seat, a first nodal point component and a second nodal point component, wherein the pressure-equalising device main body can be rotatably provided on the base seat; the first nodal point component and the second nodal point component are respectively arranged at both ends of the pressure-equalising device main body and are respectively matched with and connected with the corresponding steel rope set; the first nodal point component and the second nodal point component can respectively rotate around rotational centers thereof, the rotational centers of the first nodal point component and the second nodal point component and a rotational center of the pressure-equalising device main body are on a same horizontal plane, and a moment of the first nodal point component relative to a vertical center line of the pressure-equalising device main body is equal to a moment of the second nodal point component relative to the vertical center line of the pressure-equalising device main body, wherein the rotational center of the pressure-equalising device main body is located on the vertical center line of the pressure-equalising device main body; the first nodal point component and the second nodal point component respectively comprise one spherical nodal point, and the pressure-equalising device main body is symmetrically provided with 2 spherical cavities; and the spherical nodal point is arranged in each spherical cavity, and can rotate or swing, wherein a lower portion of the pressure-equalising device main body is provided with a rotating mount; the vertical center line of the pressure-equalising device main body and a vertical center line of the rotating mount are collinear; a bottom of the rotating mount is provided with an arc-shaped bump; the base seat is provided with an arc-shaped groove; and when the arc-shaped bump is arranged in the arc-shaped groove, the arc-shaped bump can rotate around the arc-shaped groove.

2. The nodal point pressure-equalising device of the steel rope sets for the elevator according to claim 1, wherein the first nodal point component comprises a first spherical nodal point; the center of the first spherical nodal point is provided with a first through hole; the first through hole is used for mounting the steel rope set; the second nodal point component is symmetrically provided with 2 second spherical nodal points along the center surface of the second nodal point component; the rotational center of the second nodal point component is located on the center surface; the center of the second spherical nodal point is provided with a second through hole; and the second through hole is used for mounting the steel rope set.

3. The nodal point pressure-equalising device of the steel rope sets for the elevator according to claim 2, wherein the rotational center of the second nodal point component and the rotational center of these 2 second spherical nodal points arranged on the second nodal point component are on the same horizontal plane and are collinear; and the rotational center of the second nodal point component, the rotational center of the pressure-equalising device main body and the rotational center of the first nodal point component are on the same horizontal plane and are collinear.

4. The nodal point pressure-equalising device of the steel rope sets for the elevator according to claim 3, wherein the distance from the rotational center of the second nodal point component to the rotational center of the pressure-equalising device main body is half of the distance from the first nodal point component to the rotational center of the pressure-equalising device main body.

5. The nodal point pressure-equalising device of the steel rope sets for the elevator according to claim 2, wherein the bottom of the pressure-equalising device main body is provided with a first spherical bump; the base seat is provided with a first spherical cavity; the first spherical bump is placed in the first spherical cavity, and the first spherical bump can rotate around the first spherical cavity.

6. The nodal point pressure-equalising device of the steel rope sets for the elevator according to claim 2, wherein the lower portion of the second nodal point component is provided with a rotating mount; the center surface of the second nodal point component is overlapped with the center surface of the rotating mount arranged on the second nodal point component; the bottom of the rotating mount is provided with a second spherical bump; one end of the pressure-equalising device is provided with a second spherical cavity; the other end is provided with a fourth spherical cavity; the second spherical bump is arranged in the second spherical cavity; the second spherical bump can rotate around the second spherical cavity; the fourth spherical cavity is internally provided with a first spherical nodal point; and the first spherical nodal point can rotate around the fourth spherical cavity.

7. The nodal point pressure-equalising device of the steel rope sets for the elevator according to claim 6, wherein the second nodal point component is symmetrically provided with 2 third spherical cavities along the center surface; each third spherical cavity is internally mounted with a second spherical nodal point, and each second spherical nodal point can rotate in the third spherical cavity.

8. The nodal point pressure-equalising device of the steel rope sets for the elevator according to claim 7, wherein the pressure-equalising device main body is provided with a screw hole, screws can fix the rotating mount at the lower portion of the pressure-equalising device main body via the screw hole.

9. The nodal point pressure-equalising device of the steel rope sets for the elevator according to claim 1, wherein the first nodal point component comprises a balancing seat and three spherical nodal points mounted on the balancing seat.

10. The nodal point pressure-equalising device of the steel rope sets for the elevator according to claim 9, wherein the balancing seat is in a shape of right triangle, these three spherical nodal points are located on positions of three included angles and are arranged in a way of centrosymmetry.

11. The nodal point pressure-equalising device of the steel rope sets for the elevator according to claim 9, wherein the second nodal point component comprises a balancing seat and two spherical nodal points symmetrically mounted on the balancing seat together.

12. The nodal point pressure-equalising device of the steel rope sets for the elevator according to claim 11, wherein the first nodal point component and the second nodal point component are respectively provided with rotating mounts, the rotating mount is provided with a spherical bump, both ends of the pressure-equalising device main body are respectively provided with a spherical cavity, and the spherical bump can be arranged in the spherical cavity in a swinging way.

13. The nodal point pressure-equalising device of the steel rope sets for the elevator according to claim 12, wherein the rotational center of the first nodal point component, the rotational center of the second nodal point component and the rotational center of the pressure-equalising device main body are located on the same plane, and the distance from the rotational center of the second nodal point component to the rotational center of the pressure-equalising device main body is 1.5 times of the distance from the rotational center of the first nodal point component to the rotational center of the pressure-equalising device main body.

14. The nodal point pressure-equalising device of the steel rope sets for the elevator according to claim 1, wherein the rotational center of the first nodal point component, the rotational center of the second nodal point component and the rotational center of the pressure-equalising device main body are located on the same plane and are collinear.

15. The nodal point pressure-equalising device of the steel rope sets for the elevator according to claim 1, wherein the base seat is uniformly distributed with fixed holes to conveniently mount the base seat.

16. The nodal point pressure-equalising device of the steel rope sets for the elevator according to claim 1, wherein the nodal point pressure-equalising device is mounted at the heat or the tail of the steel rope.

* * * * *